US005403086A

United States Patent [19]

Lindesay

[11] Patent Number: 5,403,086

[45] Date of Patent: Apr. 4, 1995

[54] MIXING DEVICE

[75] Inventor: Philip E. Lindesay, Auckland, New Zealand

[73] Assignee: Scepter Manufacturing Company Limited, Ontario, Canada

[21] Appl. No.: 82,914

[22] Filed: Jun. 29, 1993

Related U.S. Application Data

[63] Continuation of Ser. No. 965,689, Oct. 22, 1992, abandoned, which is a continuation of Ser. No. 690,255, Apr. 23, 1991, abandoned.

[30] Foreign Application Priority Data

Apr. 16, 1991 [NZ] New Zealand ..... 237848

[51] Int. Cl.[6] ..... B28C 5/18

[52] U.S. Cl. ..... 366/59; 366/227; 366/228; 366/347

[58] Field of Search ..... 366/53–59, 366/220, 227, 228, 242, 347, 605, 219, 225, 226; D9/393, 395, 399, 349; 215/1 C, DIG. 8; 220/669, 671, 673–675

[56] References Cited

U.S. PATENT DOCUMENTS

| | | | |
|---|---|---|---|
| 20,059 | 7/1890 | Irwin | D9/393 |
| 124,112 | 2/1872 | Bradley | 366/225 |
| 814,803 | 3/1906 | Ransome | 366/57 |
| 1,176,678 | 3/1916 | Heaphy | 366/225 |
| 2,018,112 | 10/1935 | Ball | 366/54 |
| 2,063,013 | 12/1936 | Cooper | 220/669 |
| 2,262,642 | 11/1941 | Liberson | 220/675 |
| 2,338,820 | 1/1944 | Peters | 366/59 |
| 3,172,644 | 3/1965 | Smith . | |
| 3,607,703 | 9/1971 | Hadley | 366/220 |
| 4,078,263 | 3/1978 | Campbell . | |
| 4,172,365 | 10/1979 | McClintock | 366/54 |
| 4,225,246 | 9/1980 | Bridge | 366/57 |
| 4,474,478 | 10/1984 | DeLong | 366/228 |
| 4,521,116 | 6/1985 | Adsit | 366/54 |
| 4,634,284 | 1/1987 | Bishop | 366/228 |
| 4,916,672 | 4/1990 | McCrory | 366/242 |
| 4,950,082 | 8/1990 | Carlson | 366/605 |

FOREIGN PATENT DOCUMENTS

| | | | |
|---|---|---|---|
| 365154 | 4/1990 | European Pat. Off. | 366/220 |
| 16837 | 7/1956 | Germany | 366/228 |
| 2631279 | 11/1989 | Germany | 366/54 |
| 8802687 | 6/1990 | Netherlands . | |
| 907581 | 10/1962 | United Kingdom . | |
| 1019951 | 2/1966 | United Kingdom | 366/347 |
| 1102975 | 2/1968 | United Kingdom . | |
| 1152238 | 5/1969 | United Kingdom . | |
| 1537072 | 12/1978 | United Kingdom . | |
| 2159427 | 12/1985 | United Kingdom . | |
| 2217620 | 11/1989 | United Kingdom | 366/54 |
| 80/02808 | 12/1980 | WIPO . | |

*Primary Examiner*—Timothy F. Simone
*Assistant Examiner*—Terrence R. Till
*Attorney, Agent, or Firm*—Wenderoth, Lind & Ponack

[57] ABSTRACT

A mixing device such as a concrete mixer is provided in the form of a hollow cylindrical drum with an opening at one end. A lid is engageable with the drum to close the opening. At least one and preferably two baffles are provided within the drum and these are shaped so as to cause an end to end as well as tumbling movement of the contents of the drum when the drum is rolled along a ground surface.

19 Claims, 5 Drawing Sheets

MIXING DEVICE

This application is a continuation of now abandoned application, Ser. No. 07/965,689, filed Oct. 22, 1992, which is a continuation of now abandoned application Ser. No. 07/690,255, filed on Apr. 23, 1991.

BACKGROUND OF THE INVENTION

This invention relates to a mixing device which has been devised particularly though not necessarily solely for mixing materials such as cement, mortar, plaster and grout, but it will be apparent that the mixing device could also be used for mixing other materials such as fertilizer stock feeds, seed, soil mixes, paint or other wet or dry ingredients that require combining.

Referring in particular to concrete mixing devices, various approaches to mixing small batches of cement to form concrete have been tried. For example mixing can be achieved by using spades or shovels on a ground surface. Such an approach is disadvantageous in that it is difficult to mix the ingredients in that considerable effort is required and this approach is therefore physically exhausting. If several batches are to be mixed, the person making the mix requires ideally to be a strong and physically fit person. A flat surface is required and often the mixed product has to be transported from the area of mixing to the area of use often in an unsatisfactory manner requiring the use for example of buckets or the like. Consistency between sequential mixes can be difficult to obtain and the mixing can create considerable mess particularly when effected by persons having little experience in making such a mix. In such circumstances the cleaning up after the mixing operations can be difficult.

In an alternative method the mixing can be carried out for example in a wheel barrow. Again there are disadvantages in that the ingredients are difficult to mix and again a strong physically fit person is ideally required because of the physically exhausting nature of the mixing. Again it is difficult to get consistency between sequential mixes and the mixing can be messy and cleaning the utensils again can be difficult.

A standard concrete mixer may be employed but generally this is disadvantageous in that a power source is required and also the concrete mixer is relatively expensive to rent or to buy. Concrete mixers are also difficult to transport and again they are such as to ideally require a strong physically fit person to use because again considerable effort is required to fill and empty the mixer. Again transportation to the place of use from the mixing point may prove difficult and difficulties are met in the cleaning of utensils. When not in use the standard concrete mixer is difficult to store.

In an effort to overcome these disadvantages Australian patent specification 584592 describes a construction which can be rolled along the ground. The construction takes the form of a truncated cone and a flange is provided at each end to provide the basis for the rolling action. An aperture is provided at the narrow end of the cone through which the mixer can be filled or emptied.

The construction is again disadvantageous however in that the quantity of mix that can be contained is small otherwise leakage will occur through the opening and also the mixing protrusions or blades will provide an inadequate mixing rate.

Because of this a substantial mixing period is required and again substantial effort must be expended to satisfactorily mix the contents and also a large number of mixes will need to be made to achieve any satisfactory quantity of cement.

SUMMARY OF THE INVENTION

It is therefore an object of the present invention to provide a mixer which will obviate or minimize the foregoing disadvantages in a simple yet effective manner or which will at least provide the public with a useful choice.

Accordingly, the invention consists in a mixing device comprising a hollow cylinder having an opening at one end, a lid engagable with the cylinder to close the opening, and at least one baffle extending inwardly from the cylindrical wall of the drum. The baffle is constructed so that upon rotation of the drum about its longitudinal axis and with the longitudinal axis substantially horizontal in use, the baffle or baffles will cause material within the drum to be tumbled and moved in a direction generally towards an end of the cylinder. The cylinder is sized so as to be manually rotatable about the longitudinal axis.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DETAILED DESCRIPTION OF THE INVENTION

Figure 1:
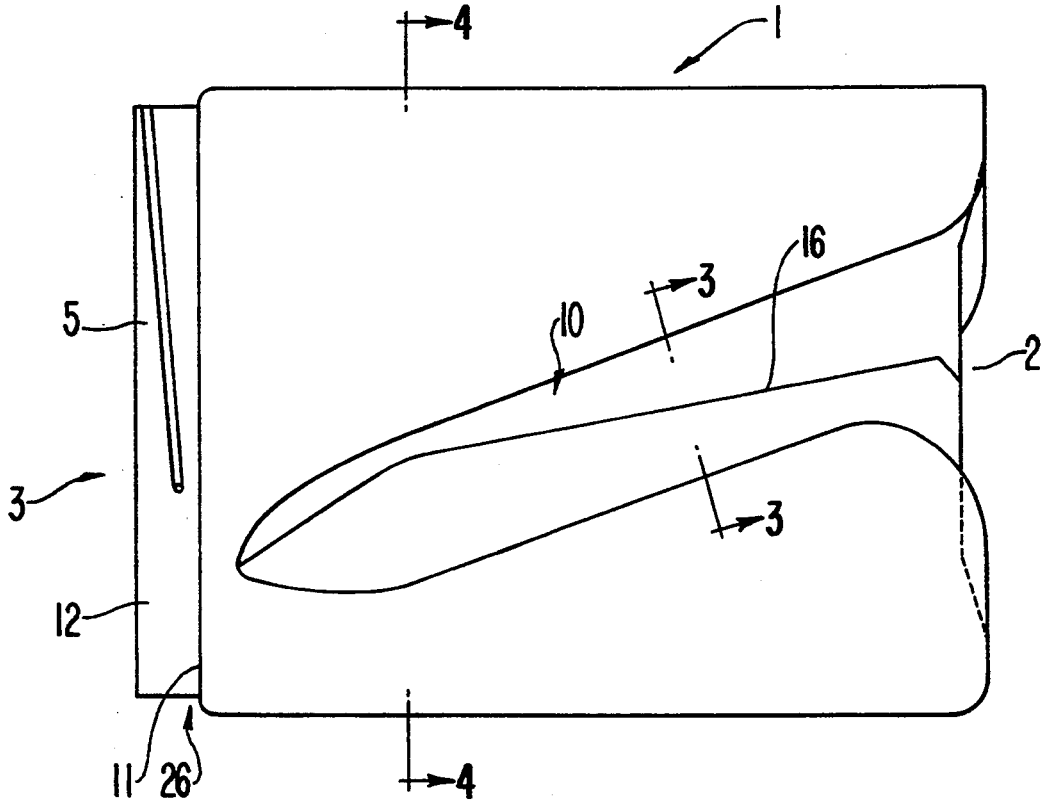
FIG. 1 is a side elevation of a mixing device according to one preferred form of the invention.
Figure 2:
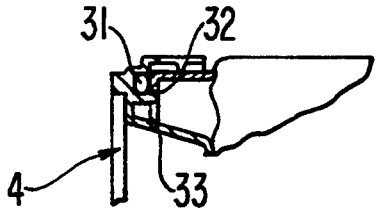
FIG. 2 is a detail view partly in cross section showing the engagement between a lid and cylindrical container part of a mixing device according to the invention.
Figure 3:
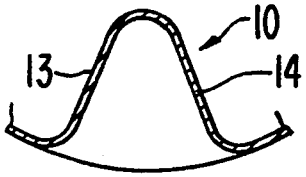
FIG. 3 is a cross section view taken along line 3—3 in FIG. 1.

Referring to the drawings, a mixing device such as a concrete mixer is provided in the form of a hollow cylinder or drum 1 closed at end 2 which forms the bottom of the construction during filling and open at the end 3 through which the mixing device can be filled in use.

Engagable over the opening at end 3 is a lid 4 and engagement between the lid 4 and the cylindrical drum 1 may be by means of co-operating threads 5 on the cylindrical drum 1 and 6 on the lid 4.

The lid 4 can be formed from any desirable material and any desirable method but is for example injection moulded from high density polyethylene.

Similarly the drum 1 may be formed in any desired manner from any desirable material but desirably is blow moulded from high density polyethylene.

Whilst the precise dimensions of the drum are not crucial to the invention the construction is of a size such that it is readily moveable by manual operation, that is to say by the hands or feet of the user and to this end it has been designed to mix for example 25 kg of cement.

A suitable size for the drum would give a height of about 440 mm with a diameter of about 320 mm and the base end 2 may be slightly concave.

At least one and preferably a pair of baffles 10 are provided. In the preferred embodiment described herein the baffles are oppositly positioned and extend from the base 2 to a point within about 50 mm from the shoulder 11 where an inward step is provided to the threaded part 12 which receives the lid 4.

The baffles are shaped so that the contents during mixing will not only be tumbled but also moved in a direction towards the ends 2 and 3 of the drum 1. This can be achieved by providing the baffles in the form a helix and in a preferred embodiment of the invention the included angle between the side walls 13 and 14 of each baffle 10 may be about 45°.

Figure 4:
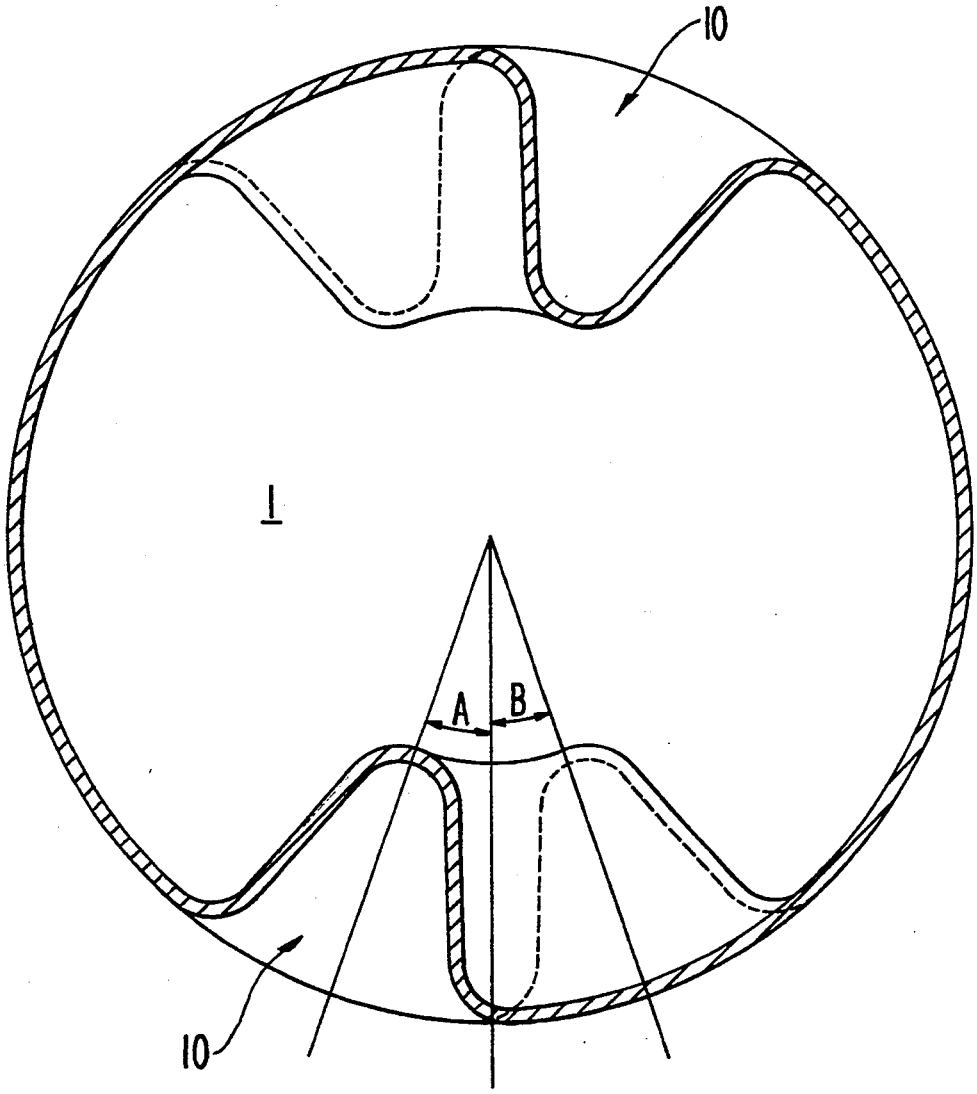
FIG. 4 is a cross section view taken along line 4—4 in FIG. 1.
Figure 5:
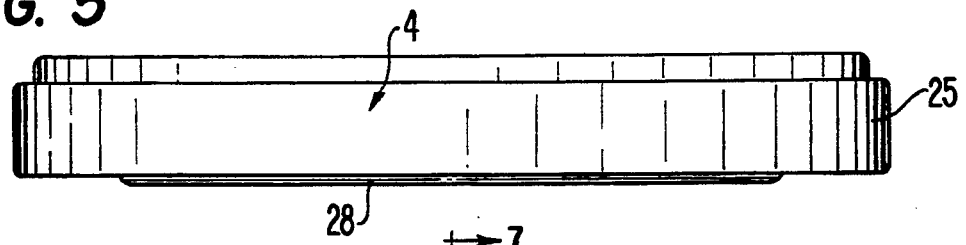
FIG. 5 is a side elevation of a lid for use in the mixing device of the invention.
Figure 6:
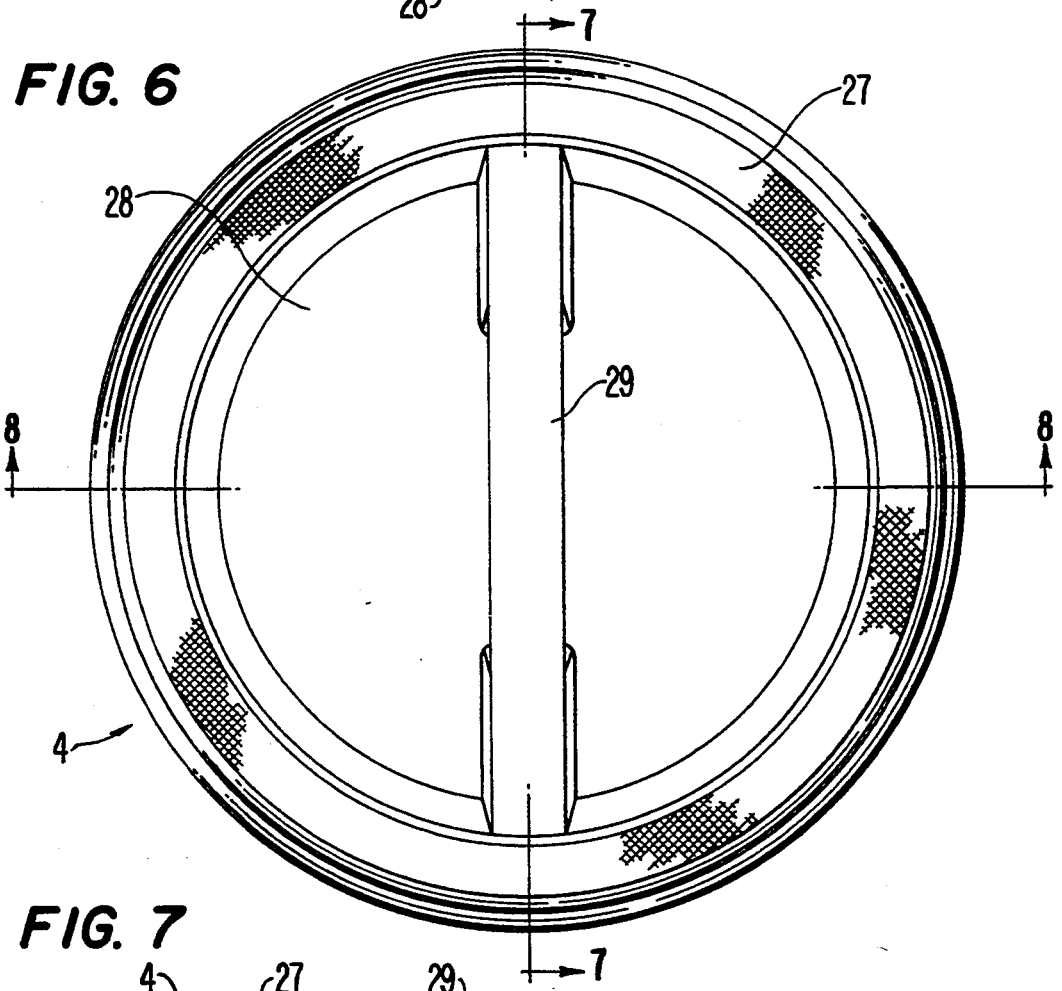
FIG. 6 is a plan view of the lid in FIG. 5.
Figure 7:
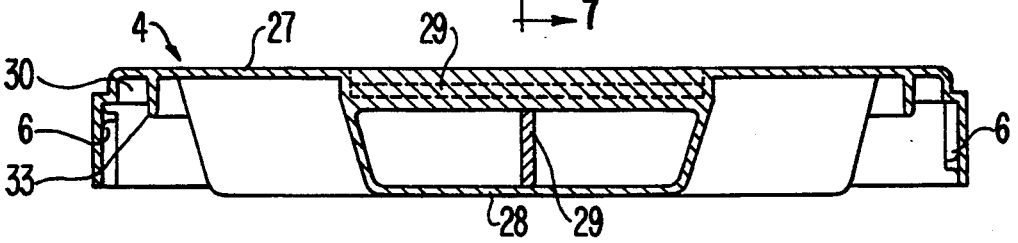
FIG. 7 is a cross section view taken along line 7—7 in FIG. 6.
Figure 8:
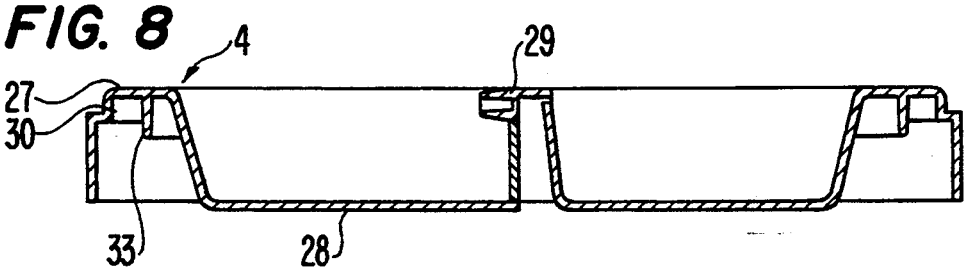
FIG. 8 is a cross section view taken along line 8—8 in FIG. 6.
Figure 9:
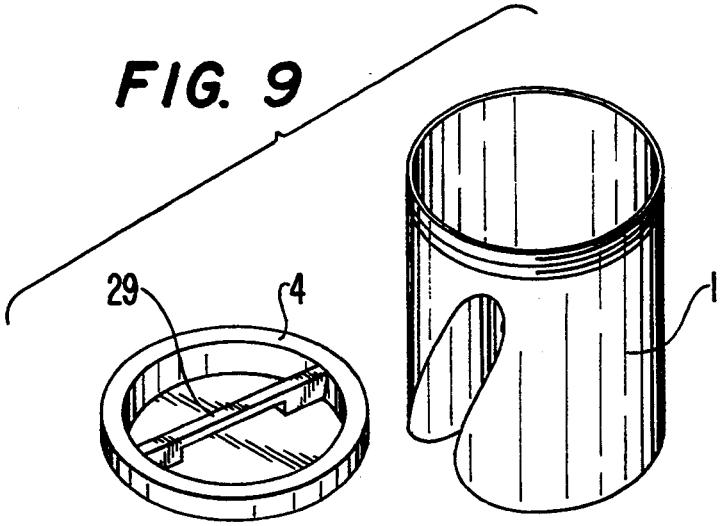
FIG. 9 is a diagrammatic perspective view of a mixing device according to the invention with the lid and container part separated.
Figure 10:
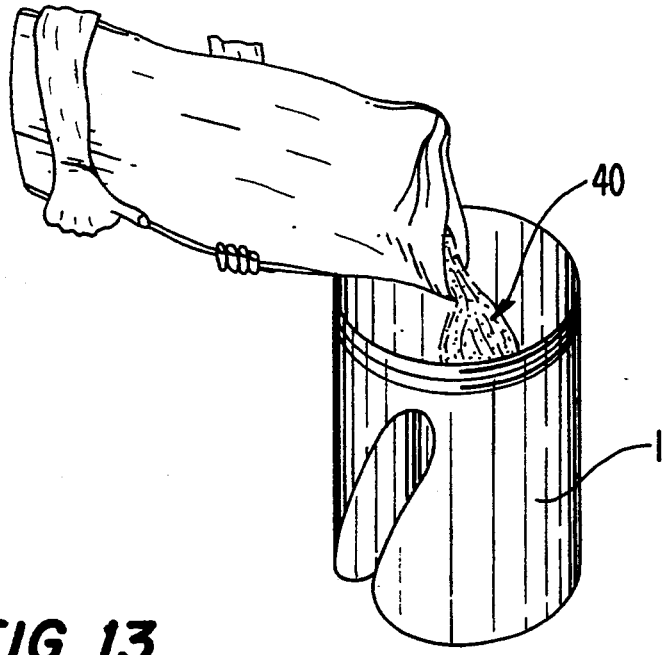
FIG. 10 shows material being inserted into the container part of the mixing device according to the invention.

The angle between the centre line of the baffle and the extremity of the baffle 10 being angle A in FIG. 4 may be about 15½° at the line 4—4 in FIG. 1 and towards its inner most end the angle B may have increased to about 22½°.

Because of the helical shape it will be found that the general axis of the baffle 10 at the cylindrical wall (i.e. an axis disposed between and parallel to radially outermost portions of sidewalls of the baffle 10) will form an angle with the general (or apex) at the inward extremity of the baffle 10 and this angle can be visualized by reference to the line 16 in FIG. 1 which indicates the direction of the innermost extremity (or apex) of the baffle 10. Thus, as shown in FIG. 1, the line 16 (representing the apex of the baffle 10) is substantially non-parallel to lines extending along the radially outermost portions of the sidewalls of the baffle 10.

Thus it can be seen that although the baffles 10 are provided on a helix the amount of turn of the helix over the length of the drum 1 is relatively small.

The external surfaces of the baffle 10 can be gripped so as to assist in rotation of the drum and also provides a convenient hand grip for ease of pouring.

The lid 4 provides a cylindrical wall 25 which in use becomes positioned about the inset portion (or reduced diameter portion) 26 of the drum 1 formed by the shoulder at 11.

The cylindrical wall leads to an upper surface (or raised portion) 27 which in the preferred embodiment includes a concavity 28 in its central portions. This concavity 28 can be used to provide a water measure to assist with recipe proportions and to this end can be marked with markings indicating water levels.

Spanning opposite sides of the raised portion 27 is a handle 29 which may be strengthened by a connection between the handle 29 and the bottom of the concavity 28 if needed or desired.

An annular cavity 30 is provided on the underside of the lid into which may be positioned a seal such as an O-ring 31 which may be retained in place by a rib 32 which extends inwardly relative to the groove or channel 30 from downwardly depending rib 33.

The use of the invention is as follows.

In use the lid 4 is removed from the drum 1 for example by pressure on the handle 29 which may also be used to carry the construction when the lid 4 is in position on the contained drum 1.

Ingredients 40 to be mixed are then inserted into the interior of the drum 1 and, if required, water or other liquid 41 is also inserted thereon for example by pouring from the lid 4 as above outlined.

Figure 13:
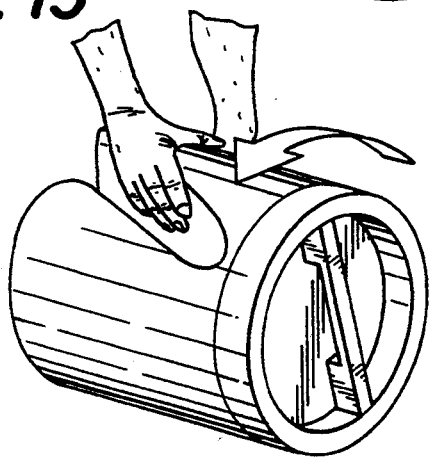
FIG. 13 shows a method of manually causing the contents of the mixing device to be mixed.
Figure 11:
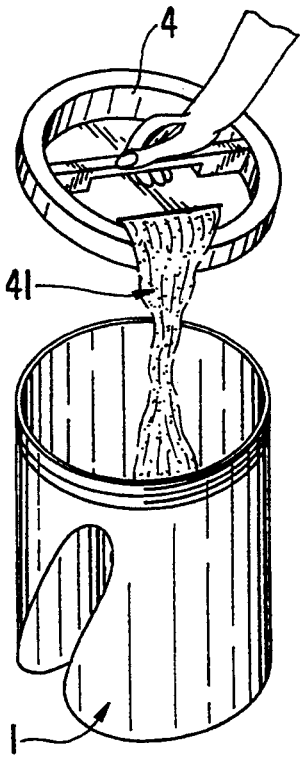
FIG. 11 shows liquid being placed into the container part of the mixing device according to the invention.
Figure 12:
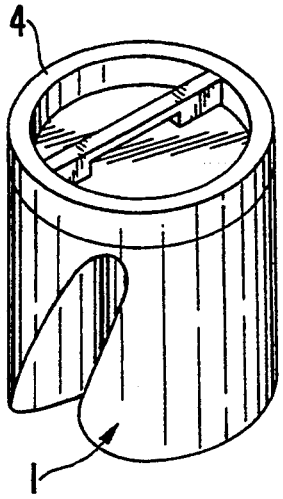
FIG. 12 shows the mixing device of the invention with the lid placed on the container.

The lid 4 is then engaged with the drum 1 as shown in FIG. 12 and the construction tipped onto its side as shown in FIG. 13.

The drum 1 may then be rolled in a to and fro manner or in one direction as desired for example by use of the hands as shown in FIG. 13 or alternatively the feet can be used.

Figure 14:
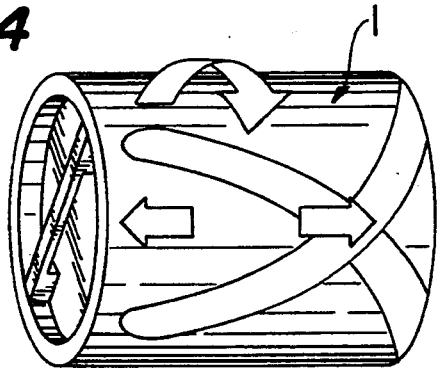
FIG. 14 shows the directions of movement of the contents of the mixing device during use.

The baffles 10 create a tumbling action whereby the ingredients are lifted, relocated within the length of the mixer, dropped and redistributed. In particular the ingredients are tumbled and also moved towards the ends of the container as shown by the arrows in FIG. 14.

It is found that a high quality mix of ingredients can be obtained in a time span of as little as 30 to 60 seconds in normal use.

The mixing can take place on substantially any surface whether it is rough, smooth or even sloping and can be performed both indoors, outdoors and in restricted space areas. Once the rolling or mixing has been completed the drum 1 is stood upright and the lid 4 unscrewed. The mixed product can either be trowelled out or simply poured from the drum 1. Cleaning can be effected by a simple hosing operation of the drum 1 and lid 4.

Thus it can be seen that a mixing device has been provided which at least in the preferred form of the invention has the advantage that where standard recipes are followed a good level of batch consistency is achieved. The construction also requires minimal physical effort in use and therefore the mixer can be used by most people. For a construction of about the size described it is found that the total weight is approximately 3.4 kg and the construction is therefore easy to carry and also because of its relatively small size can readily stored.

What we claim is:

1. A mixing device comprising:

a hollow cylindrical drum having a central longitudinal axis, a first closed end, a second open end, and a cylindrical sidewall constituting a means for rotatably supporting said drum in rolling contact with a horizontal surface, with said central longitudinal axis oriented horizontally, for rotation about said central longitudinal axis;

at least one baffle protruding inwardly from said cylindrical sidewall and extending in a substantially helical shape, said at least one baffle comprising means for causing material within said drum to be tumbled and moved toward said first end of said drum when said central longitudinal axis is positioned horizontally and said drum is rotated about said central longitudinal axis in a first direction, and for causing the material within said drum to be tumbled and moved toward said second end of said drum when said central longitudinal axis is positioned horizontally and said drum is rotated about said central longitudinal axis in a second direction opposite said first direction; and a lid engageable with said drum to close said open second end thereof, said lid having a diameter substantially equal to a diameter of said cylindrical sidewall.

2. A mixing device as recited in claim 1, wherein said at least one baffle includes two baffles protruding inwardly from said cylindrical sidewall at substantially diametrically opposite positions of said cylindrical sidewall, and each of which extends in a substantially helical shape.

3. A mixing device as recited in claim 1, wherein said at least one baffle is formed by an inwardly protruding portion of said cylindrical sidewall, such that at least one substantially helical groove is formed in an outer periphery of said cylindrical sidewall.

4. A mixing device as recited in claim 1, further comprising cooperating threads on said lid and said drum for engagement of said lid with said drum to close said open second end of said drum.

5. A mixing device as recited in claim 1, further comprising sealing means for forming a seal between said lid and said drum when said lid is engaged with said drum;

wherein said lid is cylindrically shaped; and wherein said sealing means comprises an O-ring mounted about an inner periphery of said lid.

6. A mixing device comprising:

a hollow cylindrical drum having a central longitudinal axis, a first closed end, a second open end, and a cylindrical sidewall constituting a means for rotatably supporting said drum in rolling contact with a horizontal surface, with said central longitudinal axis oriented horizontally, for rotation about said central longitudinal axis;

at least one baffle protruding inwardly from said cylindrical sidewall and extending in a substantially helical shape, said at least one baffle comprising means for causing material within said drum to be tumbled and moved toward said first end of said drum when said central longitudinal axis is positioned horizontally and said drum is rotated about said central longitudinal axis in a first direction, and for causing the material within said drum to be tumbled and moved toward said second end of said drum when said central longitudinal axis is positioned horizontally and said drum is rotated about said central longitudinal axis in a second direction opposite said first direction;

a lid engageable with said drum to close said open second end thereof, said lid having a diameter substantially equal to a diameter of said cylindrical sidewall; and wherein said at least one baffle is formed such that a first end of said at least one baffle adjacent said first end of said drum extends along a first line, and a second end of said at least one baffle adjacent said second end of said drum extends along a second line which is angled relative to said first line.

7. A mixing device as recited in claim 6, wherein said at least one baffle includes two baffles protruding inwardly from said cylindrical sidewall at substantially diametrically opposite positions of said Cylindrical sidewall, and each of which extends in a substantially helical shape.

8. A mixing device as recited in claim 6, wherein said at least one baffle is formed by an inwardly protruding portion of said cylindrical sidewall, such that at least one substantially helical groove is formed in an outer periphery of said cylindrical sidewall.

9. A mixing device as recited in claim 8, wherein said at least one baffle includes first and second sidewalls extending inwardly from said cylindrical sidewall of said drum, said first and second sidewalls meeting to form an apex at a radially innermost portion of said at least one baffle; and each of said first and second sidewalls is inclined relative to a radial direction of said drum.

10. A mixing device as recited in claim 6, wherein said at least one baffle includes first and second sidewalls extending inwardly from said cylindrical sidewall of said drum, said first and second sidewalls meeting to form an apex at a radially innermost portion of said at least one baffle; and each of said first and second sidewalls is inclined relative to a radial direction of said drum.

11. A mixing device as recited in claim 6, further comprising cooperating threads oh said lid and said drum for engagement of said lid with said drum to close said open second end of said drum.

12. A mixing device as recited in claim 6, further comprising sealing means for forming a seal between said lid and said drum when said lid is engaged with said drum;

wherein said lid is cylindrically shaped; and wherein said sealing means comprises an O-ring mounted about an inner periphery of said lid.

13. A mixing device comprising:

a hollow cylindrical drum having a central longitudinal axis, a first closed end, a second open end, and a cylindrical sidewall constituting a means for rotatably supporting said drum in rolling contact with a horizontal surface, with said central longitudinal axis oriented horizontally, for rotation about said central longitudinal axis;

at least one baffle protruding inwardly from said cylindrical sidewall and extending in a substantially helical shape, said at least one baffle comprising means for causing material within said drum to be tumbled and moved toward said first end of said drum when said central longitudinal axis is positioned horizontally and said drum is rotated about said central longitudinal axis in a first direction, and for causing the material within said drum to be tumbled and moved toward said second end of said drum when said central longitudinal axis is positioned horizontally and said drum is rotated about said central longitudinal axis in a second direction opposite said first direction;

a lid engageable with said drum to close said open second end thereof;

wherein said at least one baffle includes first and second sidewalls extending inwardly from said cylindrical sidewall of said drum, said first and second sidewalls meeting to form an apex at a radially innermost portion of said at least one baffle; and wherein lines extending along radially outermost portions of said first and second sidewalls are substantially non-parallel to a line extending along said apex of said at least one baffle.

14. A mixing device as recited in claim 13, wherein said at least one baffle includes two baffles protruding inwardly from said cylindrical sidewall at substantially diametrically opposite positions of said cylindrical sidewall, and each of which extends in a substantially helical shape.

15. A mixing device as recited in claim 13, wherein said at least one baffle is formed by an inwardly protruding portion of said cylindrical sidewall, such that at least one substantially helical groove is formed in an outer periphery of said cylindrical sidewall.

16. A mixing device as recited in claim 13, further comprising cooperating threads on said lid and said drum for engagement of said lid with said drum to close said open second end of said drum.

17. A mixing device as recited in claim 13, further comprising sealing means for forming a seal between said lid and said drum when said lid is engaged with said drum;

wherein said lid is cylindrically shaped; and wherein said sealing means comprises an O-ring mounted about an inner periphery of said lid.

18. A mixing device as recited in claim 13, wherein said lid and said cylindrical sidewall are of a substantially equal diameter.

19. A mixing device as recited in claim 1, wherein said at least one baffle includes first and second sidewalls extending inwardly from said cylindrical sidewall of said drum, said first and second sidewalls meeting to form an apex at a radially innermost portion of said at least one baffle; and each of said first and second sidewalls is inclined relative to a radial direction of said drum.

* * * * *